United States Patent [19]

Holleran

[11] 4,118,818

[45] Oct. 10, 1978

[54] APPARATUS FOR CLEANING THE LOWER PORTION OF SHOES

[76] Inventor: Eileen M. Holleran, 188 Old Field Rd., Setauket, N.Y. 11733

[21] Appl. No.: 786,034

[22] Filed: Apr. 8, 1977

[51] Int. Cl.[2] ..... A47L 23/02

[52] U.S. Cl. ..... 15/36

[58] Field of Search ..... 15/21 D, 21 E, 34, 36, 15/37, 97 A, 311, 32

[56] References Cited

U.S. PATENT DOCUMENTS

| | | | |
|---|---|---|---|
| 846,020 | 3/1907 | Feld | 15/36 |
| 1,277,834 | 9/1918 | Berdar | 15/36 |
| 1,471,826 | 10/1923 | Bzowy | 15/36 |
| 2,463,153 | 3/1949 | Conklin | 15/36 |
| 3,445,875 | 5/1969 | Bohannon | 15/36 |
| 3,737,942 | 6/1973 | Casey | 15/36 X |
| 3,849,822 | 11/1974 | Ouellette | 15/36 |

FOREIGN PATENT DOCUMENTS

| | | |
|---|---|---|
| 2,227,613 | 12/1973 | Fed. Rep. of Germany. |
| 765,669 | 3/1934 | France. |
| 60,472 | 6/1912 | Switzerland. |
| 164,576 | 6/1921 | United Kingdom. |

*Primary Examiner*—Edward L. Roberts

[57] ABSTRACT

Apparatus for quickly and easily removing the soil from the lower portions of shoes by means of powered brushes adapted to the contours of the shoe and including means for self-cleaning the brushes and collecting the soil.

8 Claims, 6 Drawing Figures

APPARATUS FOR CLEANING THE LOWER PORTION OF SHOES

BACKGROUND

1. Field

This invention pertains to power cleaning apparatus for the rapid and simple cleaning of shoes, and in particular, to the cleaning of the relatively inaccessible portions such as the instep and the area between the vamp and sole.

2. Prior Art

Prior art machines for cleaning shoes by power are generally restricted to polishing and cleaning the upper portions of the shoes. In most instances, the cleaning of the lower portions of shoes has been left to mats or other unpowered devices which generally fail to remove the soil from the more inaccessible area.

SUMMARY

It is an object of this invention to remove the soil from the lower portions of the shoes by apparatus which includes power driven rotary brushes appropriately shaped and positioned to accept the contours of the shoe. These brushes are housed within a dust shield which includes a shoe entry port to provide access to the brushing surfaces. Once the shoe has been inserted through the port, power is automatically applied to the brushes to commence the cleaning operation. After cleaning has been completed, withdrawal of the shoe automatically disconnects power from the brushes.

DETAILED DESCRIPTION OF THE INVENTION

Figure 1:
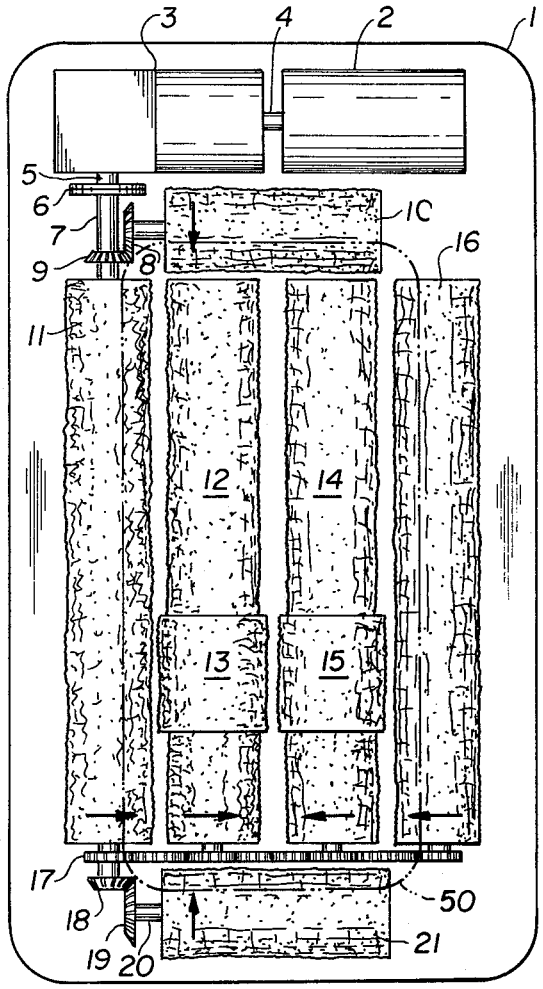
FIG. 1 is a plan view of a preferred embodiment of the invention with the dust shield removed.

The apparatus of FIG. 1 comprises a frame 1, a vacuum turbine 2, a drive motor and reduction gear assembly 3, a first drive shaft 4, a second drive shaft 5, a clutch 6, a third drive shaft 7, a left side brush 11, a bevel gear 9, a toe brush 10, a bevel gear 8, a left sole brush 12, a left instep brush 13, a right sole brush 14, a right instep brush 15, a right side brush 16, a train of gears 17 which receive power from shaft 7 and drive all the sole and side brushes, a bevel gear 19, a heel brush 21, a drive shaft 20, and a bevel gear 18 which engages the bevel gear 19 to drive the heel brush 21 through the drive shaft 20.

Figure 2:
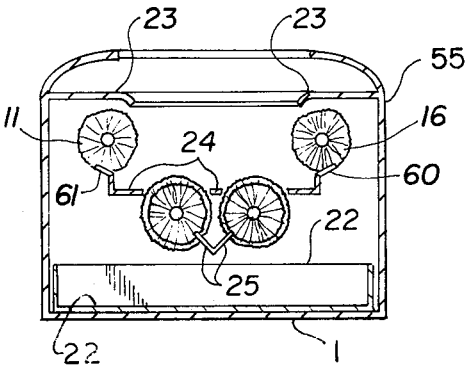
FIG. 2 is a cross sectional end view of the apparatus of FIG. 1.
Figure 3:
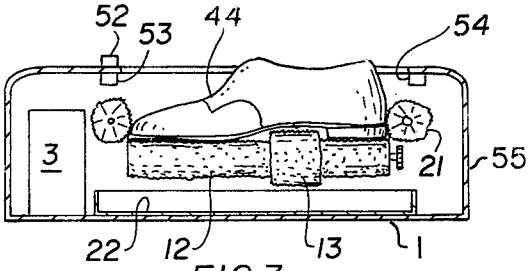
FIG. 3 is a cross sectional side view of the apparatus of FIG. 1.

In the operation of the system shown in FIG. 1, the drive motor 3 is directly connected to the vacuum turbine 2 by means of shaft 4. The direct connection to the motor without an intervening reduction gear operates at a speed that is sufficiently high to directly drive the vacuum turbine and produce a suction. The suction is applied through ducts, not shown, in the lower portion of the system, to draw the dust produced by the cleaning operation downward into a collection tray 22 located beneath the brushes as shown in FIGS. 2 and 3.

Within the motor and reduction gear assembly is a reduction gear train and right angle drive that actuates shaft 5 at a lower speed than is obtained from the direct drive connection of shaft 4 used to power the vacuum turbine. Power from the shaft 5 is applied to all brushes by way of clutch 6, which is designed to slip in the event the brushes are jammed.

Shaft 7 is the drive shaft for the left side-brush 11. This shaft also supports the bevel gear 9. Bevel gear 9 drives the bevel gear 8 which in turn drives toe brush 10. Shaft 7 continues through the brush 11 where it powers gear train 17 and bevel gear 18. Bevel gear 18 drives heel brush 21 by way of the bevel gear 19 and the shaft 20.

The gear train 17 comprises a gear on shaft 7 which drives in turn a first idler gear, a gear on the shaft of the left sole brush, second and third idler gears, a gear on the shaft of the right sole brush 14, a fourth idler gear and finally a gear on the shaft of the right sole brush 16. As a result of this arrangement of gears, all the side and sole brushes are driven in the direction shown by the direction arrows in FIG. 1. The upper surfaces of the left and right sole brushes turn towards the center of the apparatus and the heel and toe brushes also turn towards the center of the apparatus.

To clean the lower portions of the shoe, the shoe is placed into the center of the apparatus with the rear of the heel touching the heel brush and the tip of the toe touching toe brush. The left and right instep brushes clean the instep area while the sole brushes clean the soles. The left and right side brushes clean the ledge of the sole at the connection to the vamp, while the toe and heel brushes accomplish the same task in their respective regions of the shoe.

Shoes smaller than the length of the sole brushes may be cleaned by the apparatus of FIG. 1 by moving the shoe forward and back to contact the toe and heel brush and from side to side to contact the side brushes.

An alternate method of accommodating various size shoes, not shown in the drawings, is to alternately drive each set of brushes against the shoe. For example, side brushes 11 and 17 are moved towards the center of the apparatus until they contact the shoe. These brushes remain in contact with the shoe for a predetermined time and then are withdrawn. The toe and heel brush are then drawn toward the shoe in the same manner and are also withdrawn after a predetermined period.

The mechanism to drive this system is similar to that of FIG. 1 with the exception that instead of direct gear drive to the brushes, belt and pullies are applied to permit the rollers to move and the brushes are slideably mounted to the frame.

The slideable mounting is achieved by mounting the brush bearings in slotted portions of the frame which are designed to guide the brushes over a path to the shoe and back to a rest position away from the shoes. Spring bias is applied to the brushes to keep the brushes at the rest position until they are to be applied to the shoe. The brush sets are advanced toward the shoe by means of a cam coupled to the brushes by way of a spring linkage. The spring linkage prevents the brushes from advancing beyond the part of the shoe first contacted by a brush.

Returning now to the configuration shown in FIGS. 1 and 2, it should be noted that although a single sole brush may be used, a pair of counterrotating brushes, such as brushes 12 and 14, provide several advantages. This can be understood by first noting that a support plate 24, shown in FIG. 2, is used as a support for the shoe in the areas where there are no sole brushes. The direction of rotation of the pair of sole brushes tend to move the shoe towards the center of the apparatus and away from the side brushes, thereby preventing the shoe from becoming jammed between the side brush and the support plate.

The use of two or more sole brushes permits lowering the profile of the equipment. To cover the relative wide area of the sole of the shoe with a single brush would require a large diameter brush. Such a brush requires a relatively high profile apparatus to accommodate its large diameter and the high profile would be generally unsatisfactory from an aesthetic point of view.

It is easier to clean shoes with two or more sole brushes. The larger diameter brush would be more difficult to use because its larger size would result in a relatively high protrusion of the brush above the support plate. If the shoe were forced to the side by the brush rotation, the shoe may be twisted appreciably before it touched the support plate. The drop from top of the brush to the support plate for the smaller diameter brushes is considerably less than that of a single large diameter brush and therefore the smaller brushes provide a safety advantage.

FIG. 2 is a cross sectional end view of the system shown in FIG. 1 and comprises the frame 1, a dust shield 55, and a removable collection tray 22 located in the lower portion apparatus. The sole brushes are shown located in the lower portion of the equipment. The left and right side brushes are located adjacent to the sole brushes in the upper portion of the equipment. A portion of the dust shield 23 extends over the side brushes to expose only one edge of the brushes. In a similar manner, the supporting plate, which contains a number of openings to permit the debris from the shoes to fall through, also contains two larger openings corresponding to and aligned with the sole brushes to expose the upper portion of these brushes, while protecting the shoe from the gears and other drive mechanisms located below the plate.

A comb 25 comprised of two rectangular bars or a single "V" shaped bar is oriented to extend a longitudinal edge of each bar into the sole brushes to dislodge accumulated debris from the brushes. The combs are located with respect to the brushes at a position which causes the debris on the brush to be sprayed into the collection tray. Although not shown, similar combs are installed in each brush in appropriate position to direct the spray of debris away from the shoe and preferably downward towards the collection tray Comb bars 60 and 61 for brushes 11 and 16 are typical examples.

FIG. 3 shows a side cross sectional view of the system of FIG. 1 with a shoe placed on the sole brush. In this Figure, the way in which the toe the heel brushes clean and shoe can be seen. The instep brush is designed to remove the debris collecting in front of the heel. The instep brush may be a separate brush or a raised portion of the brushing surface on the sole brush.

Figure 4:
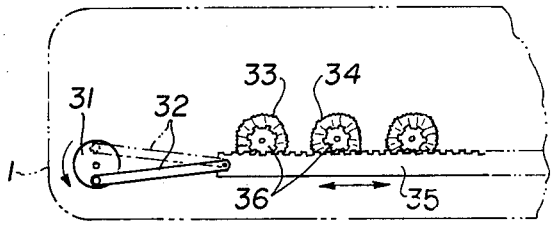
FIG. 4 is a plan view of an alternate arrangement of the side brushes and drive mechanism for the apparatus of FIG. 1.

FIG. 4 shows a plan view of an alternate arrangement for the side brushes. Rather than a single side brush for each side of the shoe, a plurality of small vertical brushes is used. The advantage of this arrangement is that the vertical brushes are better able to enter the crevice between the sole and vamp. The drive mechanism for this arrangement comprises a cam 31, a linking member 32, a rack 35, and a series of pinion gears 36 connected to the shaft of each of the vertical brushes, such as brushes 33 and 34. The rack and pinion drive is designed to cause the brushes to make at least a complete revolution for each revolution of cam 31. In this way, the brushes are scraped against their respective combs over their complete periphery so that the brushes are completely cleaned during each revolution.

Figure 5:
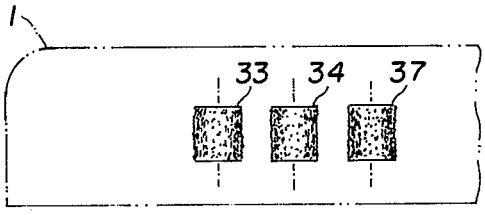
FIG. 5 is a side cross sectional view of the alternate arrangement of side brushes of FIG. 4.

FIG. 5 is a side cross sectional view of the alternate side brush arrangement shown in FIG. 4.

Figure 6:
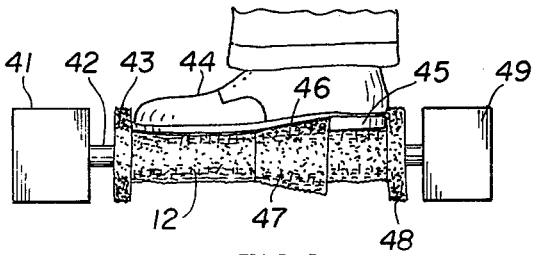
FIG. 6 is a side view of an alternate type of sole brush and drive systems.

FIG. 6 is an alternate arrangement of the sole brush. This arrangement comprises a drive motor 4, an alternate form of toe brush 43 and heel brush 48 produced by extending a portion of the sole brush above the level of the main section, an alternate arrangement for the instep brush 46, wherein a taper is employed to conform to the contour of the shoe between the heel and sole, and a vacuum turbine, all coupled to a single drive shaft 42.

The alternate arrangement shown in FIG. 6 represents a low cost version of the invention. Cost savings are made possible by mounting all the components on a single shaft to eliminate all the gears and many of the bearings required in the embodiment of FIG. 1 and by using a single brush to replace all the brushes in the previously described systems. The cleaning of the side of the shoe is achieved by pressing the side to be cleaned into the brush. For the purposes of safety, the brush may be run at a low speed from a reduction train within the motor housing, while the vacuum turbine may be driven directly at higher speed from the motor shaft as was done in the system of FIG. 1.

To automatically actuate all variations of the invention, a light source 53 located beneath the dust shield as shown in FIG. 3, is directed at a light receiver 54. Whenever the light beam between the light source and light detector is broken, such as occurs when a shoe is placed through the port 50 in the dust cover, outlined by the dashed line in FIG. 1, the equipment is actuated. Located outside the equipment is a manual switch indicated by drawing numeral 52, on FIG. 3. As a safety feature, this switch can be used to shut off the equipment manually thereby overriding the automatic system.

Although not shown, combination of known additional apparatus with the invention is contemplated as being within the spirit of this invention, such as combining with the present invention additional brushes to clean and polish the upper portion of the shoe at the same time or immediately after the cleaning of the lower portion.

Having described my invention, I claim:

1. Apparatus for cleaning the lower portion of a shoe comprising:

(a) a frame, (b) a generally cylindrically shaped first brush with a length longer than that of the shoe to be cleaned and a brushing surface that substantially encompasses the round surface of the brush, said brushing surface including a raised portion that conforms to the instep of the shoe, (c) means for mounting said first brush in a horizontal position in said frame for rotation of said brush about its longitudinal axis, (d) a first power means for rotating said first brush, (e) a support plate on which to rest the shoe while it is being cleaned, said plate having a plurality of openings to pass the soil from the shoe and an opening corresponding generally to the longitudinal cross section of said first brush, and (f) means for mounting said plate in said frame in the horizontal plane above the longitudinal axis of the first brush in a position to align the opening corresponding to the brush cross section with the brush and placing the plate at a level at which the upper surface of the brush is above the upper surface of the plate, whereby the brushing surface of the brush is exposed above the plate to clean the underside of a shoe while the shoe is protected by the plate from the power means for rotating said first brush.

2. Apparatus as claimed in claim 1, further comprising:

(a) a second cylindrical brush with the brushing surface substantially encompassing the round surface of the brush, (b) means for mounting said second brush in said frame above and to one side of said first brush with the horizontal axis of said second brush oriented generally parallel to that of the first brush to place the brushing surface in a position to contact the side of the shoe when the shoe is placed over said first brush, (c) second power means for rotating said second brush in a direction which drives the brushing surface in contact with the shoe downward to remove the soil between the vamp and the sole of the shoe, (d) a dust shield enclosing the entire upper surface and sides of the apparatus with an opening in the top to accept the shoe, (e) a removable soil collection tray located below said first and second brushes, and within said dust shield to collect the soil passing through the plurality of openings in the support plate as well as that removed from the brushes, (f) a first generally rectangular comb bar located below the support plate with one of the longer edges of the comb engaging the brushing surface of the first brush on the side with downward motion to dislodge soil from the brushing surface and direct it into the tray, and (g) a second rectangular comb bar with one of the longer edges engaging the brushing surface of the second brush on a side away from the shoe.

3. Apparatus as claimed in claim 2, further comprising:

(a) a third brush similar to said first brush, rotatably mounted to said frame below said plate and positioned adjacent and parallel to said first brush and at substantially the same level as the first brush, (b) a third power means to drive said third brush in a direction opposite to that of said first brush to cause the upper surface of these brushes to move towards each other, and (c) an opening in said plate generally corresponding to the longitudinal cross section of said third brush and aligned with said third brush to expose the upper surfaces of said third brush above the plate.

4. Apparatus as claimed in claim 3, further comprising:

(a) a fourth brush similar to said second brush, rotatably mounted to said frame above said plate and positioned at substantially the same level and parallel to said second brush on the opposite side of the shoe, and (b) a fourth power means to drive the surface of said fourth brush in contact with said shoe in a downward direction.

5. Apparatus as claimed in claim 4, further comprising:

(a) a fifth cylindrical brush rotatably mounted to said frame at generally the same level as said second and fourth brushes with the longitudinal axis oriented perpendicular to but in the same horizontal plane as the axes of the second and fourth brushes, and positioned to engage the toe of the shoe, (b) a sixth cylindrical brush rotatably mounted to said frame at generally the same level as said second and fourth brushes with the longitudinal axis oriented perpendicular to but in the same plane as the axes of the second and fourth brushes and positioned to engage the heel of said shoe, (c) a fifth power means for driving said fifth brush to cause the side in contact with the shoe to move in a downward direction, and (d) a sixth power means for driving said sixth brush to cause the side in contact with said shoe to move downward.

6. Apparatus as claimed in claim 5, further comprising:

(a) a light detector mounted to said frame and located beneath the dust shield, (b) a light source mounted to said frame beneath the dust shield, said source being directed at the light detector to form a light beam under the dust cover opening in a position to be interrupted by the shoe when it is placed through the dust cover opening, and (c) means connected to said light detector for actuating all said power means when said light beam is interrupted.

7. Apparatus as claimed in claim 3, further comprising:

(a) a plurality of vertical positioned cylindrical brushes located adjacent each other to encompass the entire side of the shoe, and (b) a seventh power means for rotating said plurality of vertical brushes.

8. Apparatus as claimed in claim 1, wherein said raised portion of said brush includes a taper that conforms to the shape of a shoe between the sole and the instep, said power means for driving said brush is a motor with a drive shaft, and said brush is mounted directly on said drive shaft, and said apparatus further including a vacuum turbine mounted directly on said drive shaft to produce a suction to draw the soil and dust below said support plate.

* * * * *